US005665934A

United States Patent [19]

Tuttle et al.

[11] Patent Number: 5,665,934

[45] Date of Patent: Sep. 9, 1997

[54] ARMED-STATE DETECTOR FOR ANTITANK MINES

[75] Inventors: John E. B. Tuttle, Falls Church, Va.; Neal Tesny, Ellicott City, Md.; Thomas J. Bock, Woodbridge, Va.

[73] Assignee: The United States of America as represented by the Secretary of the Army, Washington, D.C.

[21] Appl. No.: 700,747

[22] Filed: Jul. 31, 1996

[51] Int. Cl.[6] ..... B63G 9/00

[52] U.S. Cl. ..... 102/402; 89/1.1; 89/1.13; 86/50

[58] Field of Search ..... 102/402; 86/50; 89/1.1, 1.13

[56] References Cited

U.S. PATENT DOCUMENTS 4,951,058 8/1990 Schriner et al. ..... 342/61
5,007,346 4/1991 Kirkland ..... 102/402
5,307,272 4/1994 Butler et al. ..... 364/424.02
5,452,639 9/1995 Aulenbacher et al. ..... 89/1.13
5,458,063 10/1995 Laine et al. ..... 102/402

*Primary Examiner*—J. Woodrow Eldred
*Attorney, Agent, or Firm*—Freda L. Krosnick; Paul S. Clohan, Jr.

[57] ABSTRACT

An armed-state detector for the testing of "live" antitank mines is disclosed. The invention allows a user to determine, from a safe distance, if a mine is in an "active" state. A pole mounted sensor array is placed over the mine to sample the weak repetitive magnetic field that emanates from "active" mines. A hand-held, battery powered, detector box provides an audible or visual indication of whether or not the mine is "active". In addition to indicating that the mine is "active", the armed-state detector allows the user to determine the angular orientation of the magnetometer common to all antitank mines. The detector also provides a means whereby limited diagnostics can be performed on an unexploded mine. With the armed-state detector the user can determine if the fuze of an unexploded mine has been "killed" outright, or has merely failed to respond to the test stimulus.

9 Claims, 11 Drawing Sheets

ARMED-STATE DETECTOR FOR ANTITANK MINES

GOVERNMENTAL INTEREST

The invention described herein may be manufactured, used and licensed by or for the United States Government without payment to us of any royalty thereon.

TECHNICAL FIELD

The present invention relates to detection of antitank mines in general and specifically to a device to determine whether or not an antitank mine is in an active state after having been employed.

BACKGROUND ART

It has been repeatedly observed that some mines, when exposed to a test stimulus, fail to detonate and the cause of failure usually cannot be determined. The inability to determine the cause of these failures presents technical problems to scientists and engineers involved in the design and testing of these types of mines. For example, if the mine failed to detonate, was the failure due to defects in the test stimulus or in the mine? Existing test equipment and diagnostic procedures do not allow an evaluator to readily make this type of determination.

When a mine fails to detonate, four causes are generally possible:

1. The mine failed to arm.
2. The test stimulus was insufficient to cause detonation.
3. The mine was rendered inoperative (i.e., killed)
4. The mine entered a "confused" state from which it may recover. When a mine enters this state, it is difficult for test range personnel to safely manipulate the mine.

STATEMENT OF THE INVENTION

It is therefore an object of the present invention to provide a device to determine, from a safe distance, if a mine is active or not.

A further object of the present invention is to provide a device to determine, from a safe distance, the angular orientation of the magnetometer of a mine.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by providing an armed-state detector for the testing of "live" antitank mines. The invention allows a user to determine, from a safe distance, if a mine is "active" or not. A pole mounted sensor array is placed over the mine to sample a weak repetitive magnetic field that is present on the surface of "active" mines. A hand-held, battery powered detector box provides an audible or visual indication of whether or not the mine is "active". In addition to indicating that the mine is "active", the armed-state detector allows the user to determine the angular orientation of the magnetometer, that is common to all antitank mines. Angular orientation of the magnetometer is an important aspect in mine testing. The detector also provides a means whereby limited diagnostics can be performed on an unexploded mine. With the detector, the user can determine if the fuze of an unexploded mine has been "killed" out-right, or has merely failed to respond to the test stimulus.

DETAILED DESCRIPTION OF THE PREFERRED EMBODIMENT

Figure 1:
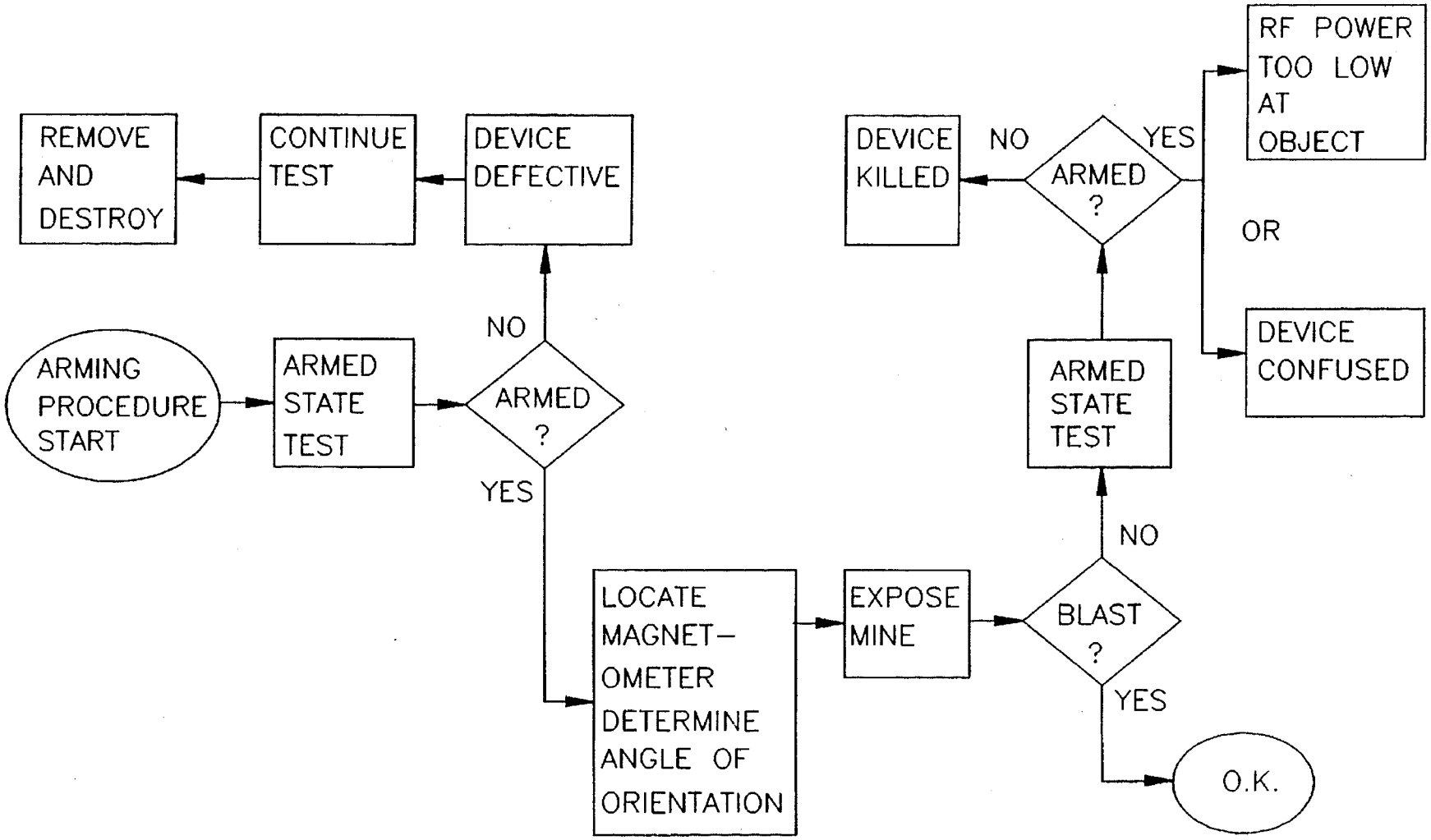
FIG. 1 is a flow chart depicting a test range diagnostic procedure using the present invention.

Referring now in detail to the drawings wherein like parts are designated by like reference numerals throughout, there is illustrated in FIG. 1 a flow chart representing the sequence of events that should be followed prior to and immediately after the discovery and exposure of an antitank mine. This procedure is a sequence of events utilized during test range diagnostics. During this sequence of events, the present invention would be used twice, once before the exposure of the mine, and once after the exposure of the mine. As part of the first armed state test, the angular orientation of the mine's magnetometer will be determined, and this angular orientation will become important for diagnosis of cases in which the mine armed yet failed to detonate.

When a mine fails to arm, it cannot be expected to detonate, especially if it is well shielded. Thus, the mine itself must be considered defective. Insufficient stimulus at the mine may or may not be the cause, and can be attributed to the angular orientation of the fuze. A body of data, accumulated from laboratory tests, and from field tests with live mines, indicates that antitank mines are more sensitive in one angular orientation than in another angular orientation. Specifically, a mine is 5.5 db more sensitive in a 0° orientation than in a 90° degree orientation, if a mine is known to have armed, yet failed to detonate, it must be determined if the fuze has been "killed" outright or has entered a logic upset. This latter mode has been observed for poorly shielded but relatively complex mines.

The present invention operates by detecting the low level, low bandwidth, repetitive magnetic field radiated by the fuze of an armed antitank mine. All U.S. made scatterable antitank mines radiate a 1 kHz asymmetrical pulse train which has a 10% duty factor, while certain foreign antitank mines radiate a 100 KHz tone modulated by the 1 KHz magnetometer signal. The present invention uses miniature inductance coils (L=2.7 millihenries) placed on the top surface of the mine, to sense these magnetic fields. These coils, when excited by these magnetic fields, generate a low level ($V_p \leqq 0.2$) time varying output voltage proportional to the magnetic field intensity. Maximum output from a coil is thus obtained on the area of the mine surface directly above the magnetometer.

Figure 2A:
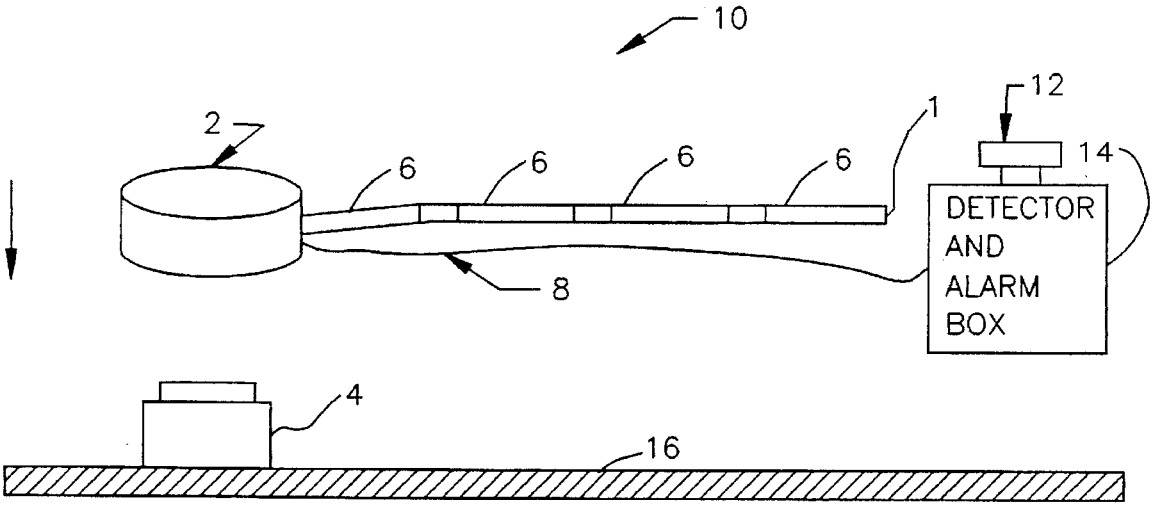
FIG. 2A is a side view depicting the pre-placement of the armed-state detector sensor array over a mine.
Figure 2B:
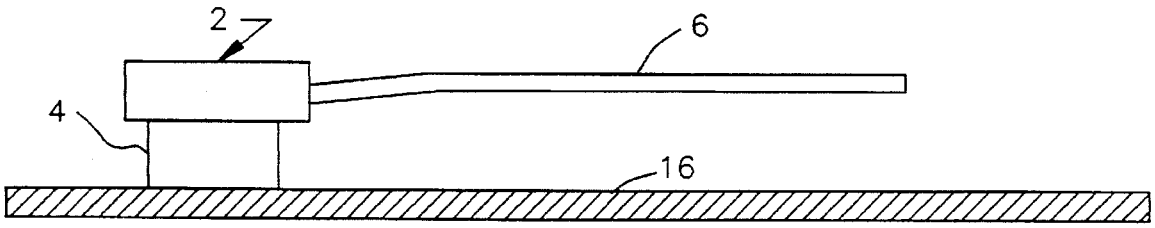
FIG. 2B is a side view depicting the final placement of the armed-state detector sensor array on a mine.

FIGS. 2A and 2B illustrate the basic components of armed-state detector 10 and its placement over mine 4 lying exposed upon ground surface 16. Armed-State Detector 10 consists of sensor array 2, pole 1 having four stackable pole sections 6, cable assembly 8, detector/alarm box 14 and selector switch 12. FIG. 2A shows the armed-state detector 10 prior to its emplacement on mine 4, while FIG. 2B shows armed-state detector 10 in its proper placement on mine 4. Once sensor array 2 is properly placed over mine 4, the user of armed-state detector 10 sequentially selects the outputs from each of eight sensors located within array 2. Selection is made via ten-position rotary switch 12 on detector/alarm box 14. When the operator has selected the sensor nearest the magnetometer coil of mine 4, an audible alarm sounds. The distance between the "live" mine 4 and the detector/alarm box 14 is approximately 11 feet.

Figure 3A:
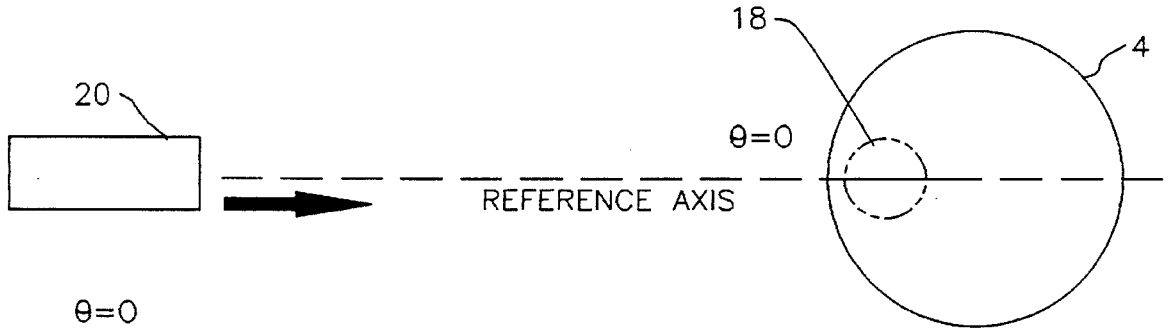
FIG. 3A depicts the 0° angular orientation of an antitank mine with respect to magnetometer coil and stimulus.
Figure 3B:
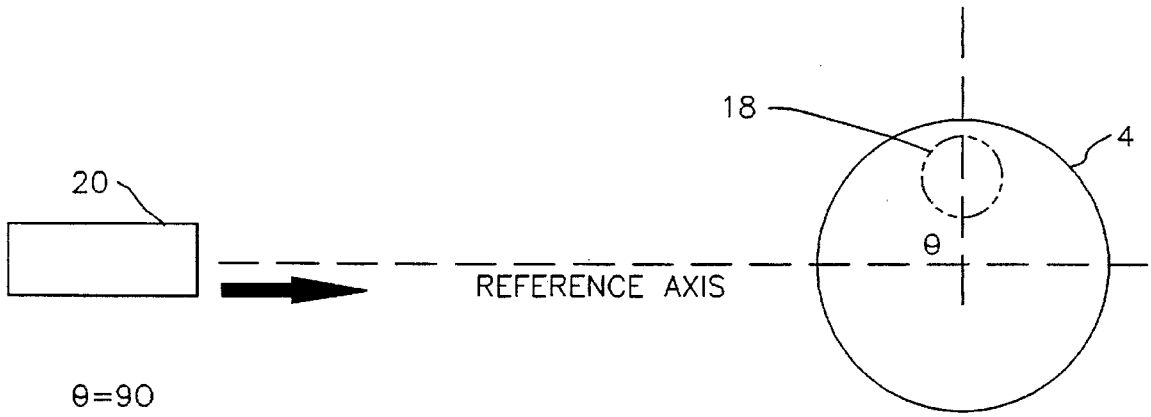
FIG. 3B depicts the 90° angular orientation of an antitank mine with respect to magnetometer coil and stimulus.

FIG. 3A shows the angular relationship between the magnetometer coil 18 of mine 4 and the longitudinal axis of a stimulus 20. FIG. 3A shows a 0° relationship and represents the most sensitive orientation of antitank mine 4 to an incident stimulus 20, while FIG. 3B shows a 90° relationship and represents the least sensitive case.

Figure 4A:
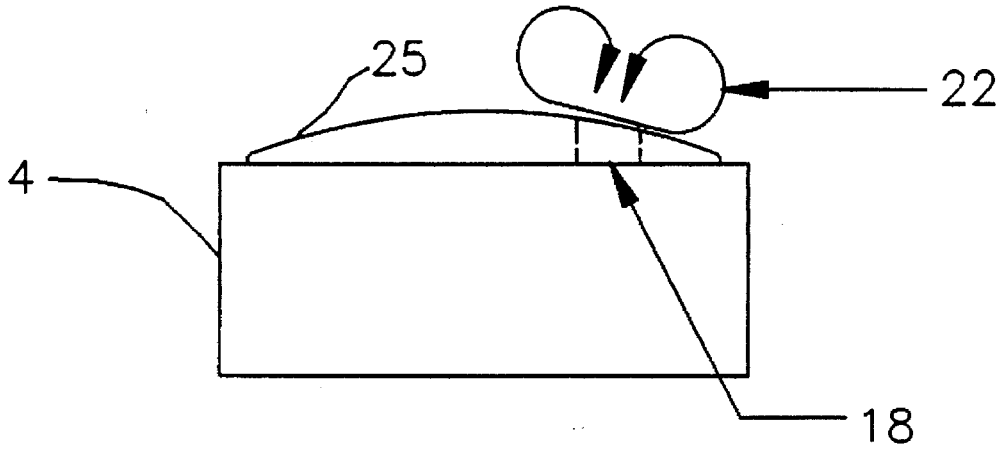
FIG. 4A is a side view showing the local magnetic field on the top surface of a mine, directly over the magnetometer coil.
Figure 4B:
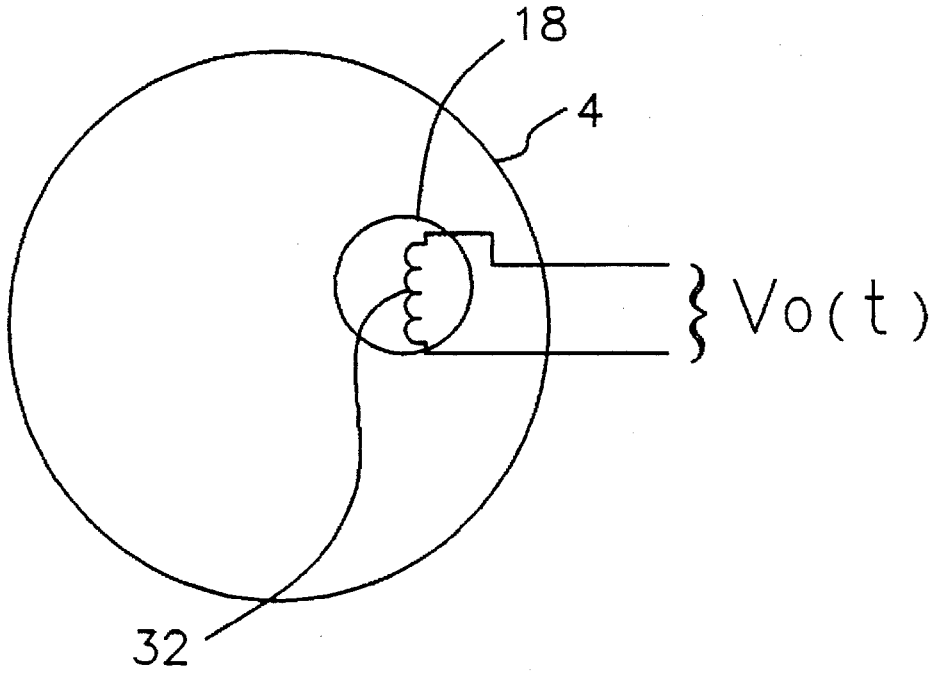
FIG. 4B is a top view showing the sensing of the local magnetic field on the top surface of a mine, directly over the magnetometer coil.
Figure 4C:
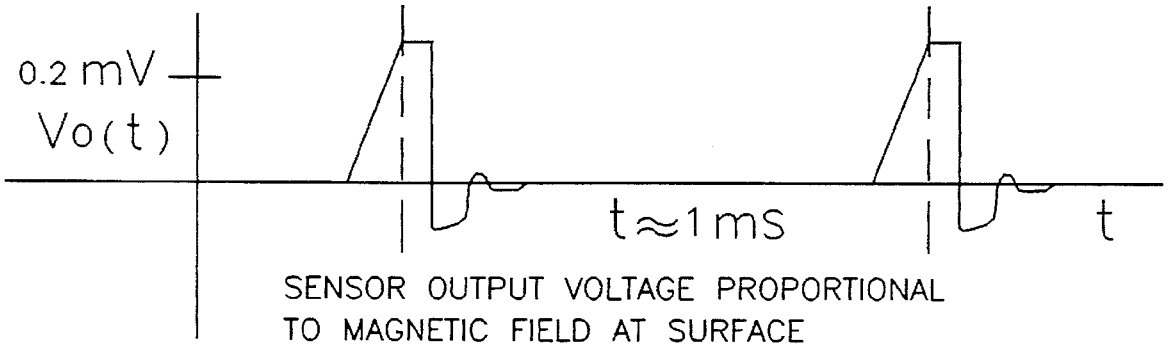
FIG. 4C shows the voltage output from a single sensor resting above the magnetometer coil.

FIG. 4A depicts the method of detecting the presence and angular orientation of magnetometer coil 18 which lies below the top surface 25 of mine 4. The magnetic field flux lines 22 emanating from magnetometer coil 18 of mine 4 is dramatically stronger directly over magnetometer coil 18 and weakens sharply with distance from the center of magnetometer 18. As shown in FIG. 4B, the device used in the present invention to detect the magnet field flux lines 22 arising from magnetometer coil 18 is a miniature ALADDIN inductive sensor coil 32 having an inductance of 2.7 millihenries. Sensing coil 32, when excited by lines of flux 22 in its vicinity, generates an output voltage $V_o(t)$ proportional to the time varying magnetic field. A representative output voltage waveform is shown in FIG. 4C.

Figure 5A:
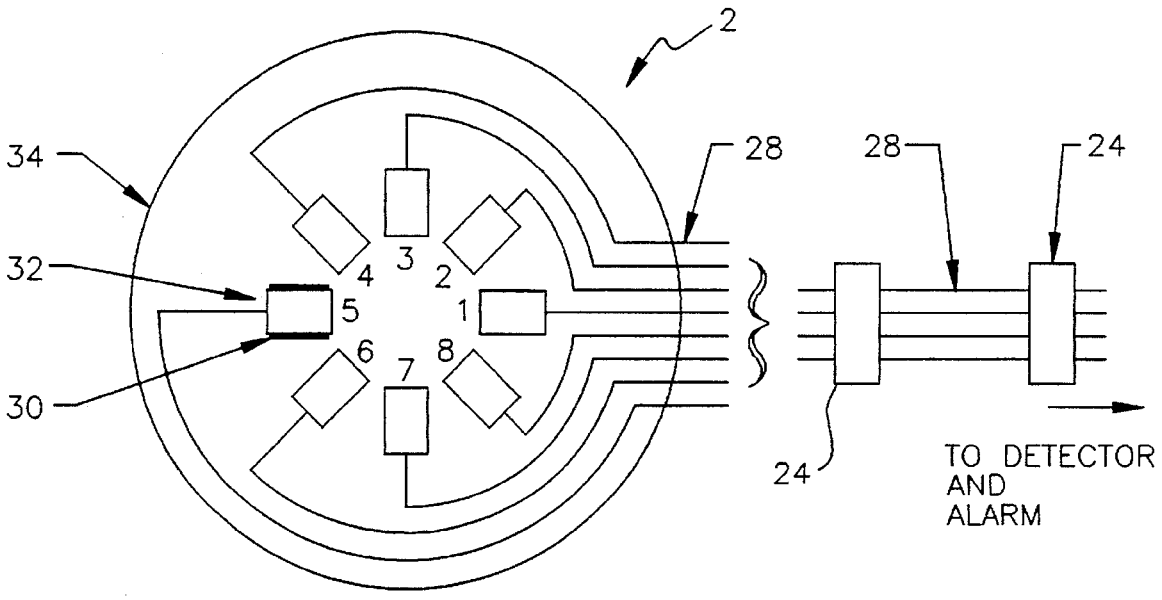
FIG. 5A is a top view of the sensor array of the armed-state detector.
Figure 5B:
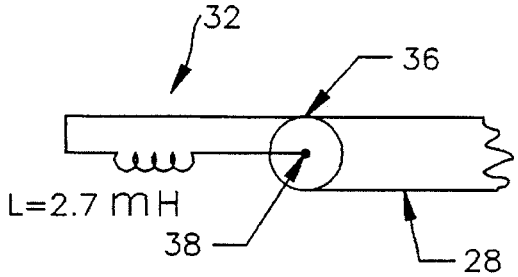
FIG. 5B is a detail view of an inductive sensor coil used in the sensor array of the armed-state detector.
Figure 5C:
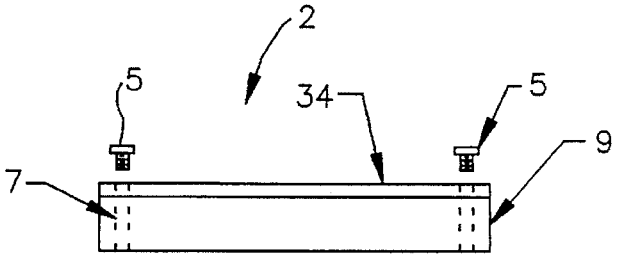
FIG. 5C is a side view of the sensor array showing the alignment cylinder attachment.

FIGS. 5A, 5B, and 5C show the components of sensor array 2. As shown in FIG. 5A, array 2 consists of eight equally spaced inductive sensor coils 32 arranged in a circle as shown. Sensor coils 32 are mounted on a VECTOR-BOARD disc 34 by RTV compound 30. Each of the eight sensor coils 32 samples the field within its sector from the surface of mine 4. The outputs of the eight sensor coils 32 are transmitted via eight thin coaxial cables 28, type R6-174 and held together by nylon cable ties 24, to a hand-held battery powered detector/alarm box 14. FIG. 5B shows the detail of the individual inductive sensor coils 32, which consist of coil 32 connected at one end to center conductor 38 of cable 28 and at the other end to shield 36 of cable 28.

Sensitivity and accuracy of armed-state detector 10 is dependent upon proper placement of sensor array 2 on the top surface of mine 4, therefore, the center of VECTOR-BOARD disc 34 and the center of mine 4 top surface must be aligned. To provide for this alignment, the VECTOR-BOARD disc 34 is attached to an alignment cylinder 9, as shown in FIG. 5C, which is a short section of clear plastic pipe with an inside diameter slightly larger than that of mine 4. This forms a cylinder open at the bottom, which serves as a guide for the sensor array 2 as it is positioned over mine 4. Alignment cylinder 9 is attached to disc 34 using two screws 5 inserted into threaded holes 7. Sensor array 2, with alignment cylinder 9 and pole 1 attached, resembles an inverted church collection basket, and thus could be called a "collection basket probe".

At the rear end of armed-state detector 10 is detector/alarm box 14 which provides audible or visual indication that sensor 2 has exceeded a preset threshold. Box 14 has a ten-position rotary selector switch 12 that provides for selection of the sensor 32 outputs. The distance between detector/alarm box 14 and sensor array 2 is maintained by a ten-foot pole 1 assembled from four stackable pole sections 6 of aluminum tubing.

When the state of a mine 4 must be determined, the user of the armed state detector 10 carefully positions sensor array 2 over the top surface of mine 4 and rotates selector switch 12, while listening for an audible alarm. The audible alarm indicates that mine 4 is alive. The switch position (1-8) at which the alarm sounded identifies the location of the sensor 32 nearest the magnetometer coil 18 of mine 4 fuze. From the newly identified location, angular orientation of the mine with respect to a reference axis can be determined.

Figure 6A:
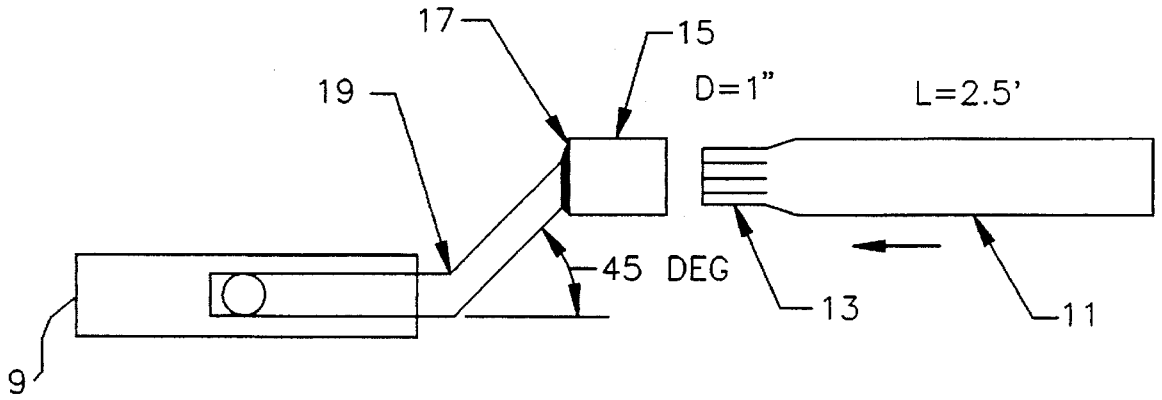
FIG. 6A is a side view depicting the pole assembly mounting to the yoke used to hold the sensor array.
Figure 6B:
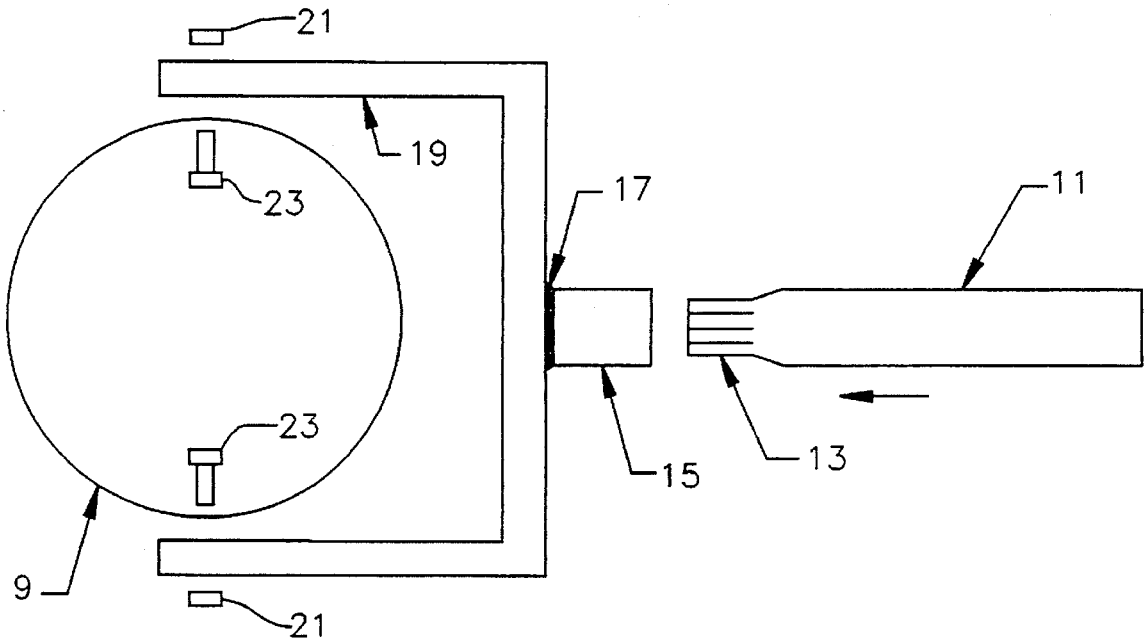
FIG. 6B is a top view depicting the pole assembly mounting to the yoke used to hold the sensor array.

FIGS. 6A and 6B show the method of attaching pole 1 assembly to sensor array 2. As shown in FIG. 6A, the connection between final pole section 11 having a crimp 13 to mate with tube 15, and the alignment cylinder 9 of sensor array 2 is a yoke constructed from ¾ inch wide aluminum strip attached to alignment cylinder 9 by two bolts 23 and two nuts 21, and is attached to tube 15 by weld 17.

Figure 7:
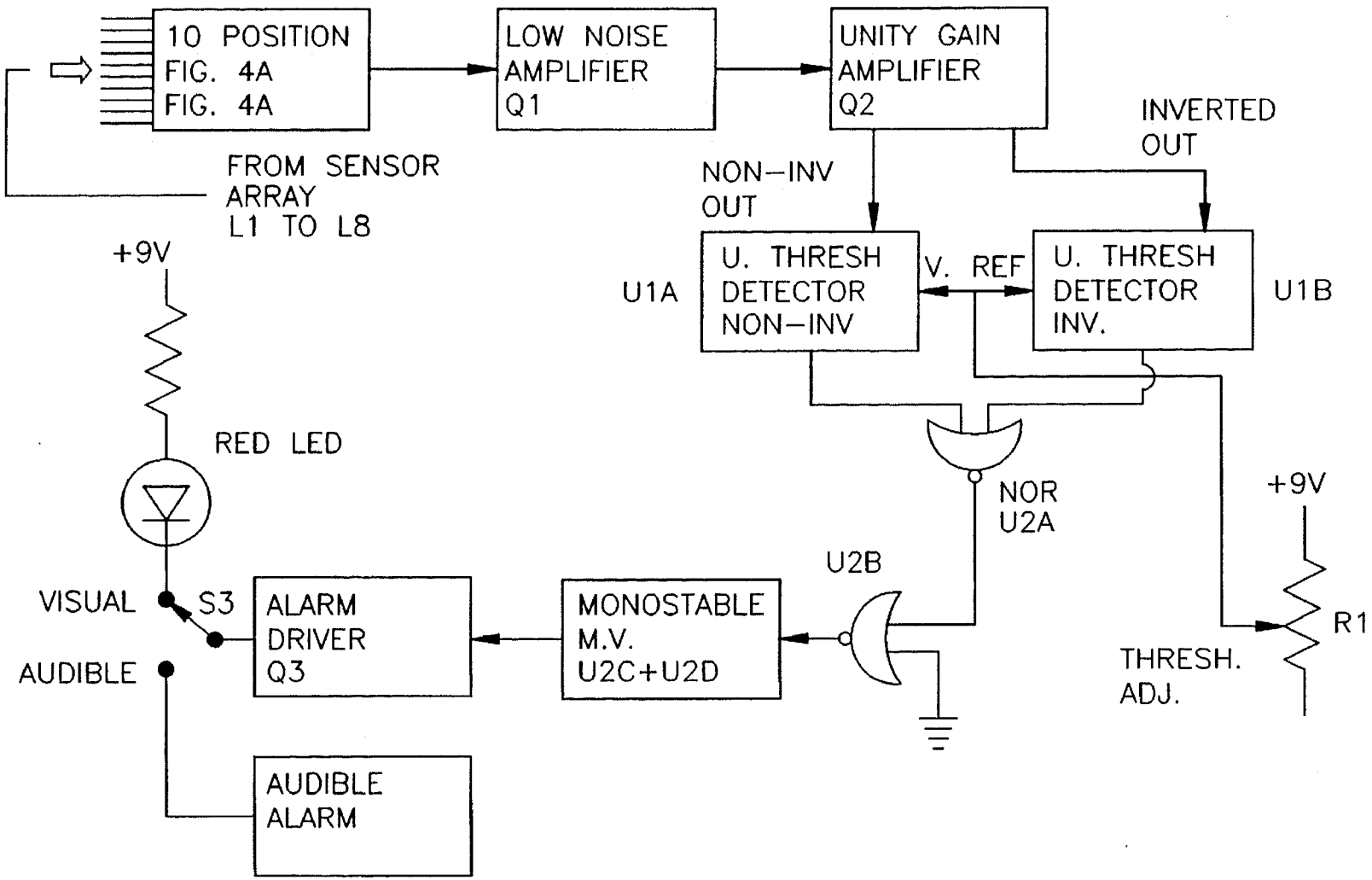
FIG. 7 is a block diagram of the detector alarm box of the armed-state detector.

A block diagram of detector/alarm box 14 is shown in FIG. 7. The function of detector/alarm box 14 is to provide for selection of the outputs from the eight numbered sensors 32, to detect the output when present, and to provide a visual or audible alarm when sensor 32 output is present. From FIG. 7 it can be seen that a signal, when present, will be amplified by Q1, split into two paths (inverted and noninverted) by Q2, threshold detected (U1A and U1B), combined (U2A, U2B), and stretched (U2C and U2D). The processed and stretched sensor output is then applied to the input of alarm driver Q3. Choice of audible alarm or visual indication is provided by switch S3. The peak amplitude of the signal to cause threshold detector state change is set by potentiometer R1 which adjusts the reference voltage. This reference adjustment is made to accommodate the type of mine that is to be tested. Once done, it remains as adjusted until a different type of mine must be tested. The detector/alarm box 14 is powered by a single 9-volt battery.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A device to determine the state of the fuze of a land mine comprising:

means for detecting the presence of a magnetic field being radiated by the fuze of said mine;

means for processing said detected magnetic field so as to indicate the state of the fuze of said land mine.

2. The device of claim 1 wherein said means for detecting the presence of a magnetic field also includes means for detecting the angular orientation of said fuze.

3. The device of claim 2 wherein said means for detecting the presence of a magnetic field comprises a sensor array placed over the surface of said mine.

4. The device of claim 3 wherein said sensor array comprises a plurality of inductive sensor coils.

5. The device of claim 4 wherein said plurality of inductive sensor coils comprises eight coils arranged in a circular fashion.

6. The device of claim 5 wherein said means for processing said detected magnetic field comprises a means for selecting each individual coil, means for amplifying a detected signal from each said coil, means to split said amplified signal into an inverted and noninverted signal, means to threshold detect said inverted and noninverted signals, means to combine said inverted and noninverted signals, means to stretch said combined signal, means to apply said stretched signal to the input of an alarm driver means, and means to provide an alarm.

7. The device of claim 6 further comprising means to set the peak amplitude of said inverted and noninverted signals to thereby set the threshold of said device.

8. The device of claim 7 wherein said means to provide an alarm comprises a visual indication.

9. The device of claim 7 wherein said means to provide an alarm comprises an audible signal.

* * * * *